United States Patent [19]

Juneau

[11] Patent Number: 4,854,365

[45] Date of Patent: Aug. 8, 1989

[54] SECTIONAL-TYPE DOOR

[76] Inventor: Pierre Juneau, 8000, 19e avenue, Ville Saint-Michel, Montreal, Quebec, Canada

[21] Appl. No.: 166,061

[22] Filed: Mar. 9, 1988

[51] Int. Cl.[4] ..... E06B 3/12

[52] U.S. Cl. ..... 160/232; 160/236; 160/40

[58] Field of Search ..... 160/232, 236, 229.1, 160/201, 40; 52/802, 809, 309.9, 309.14

[56] References Cited

U.S. PATENT DOCUMENTS

| | | | |
|---|---|---|---|
| 2,880,796 | 4/1959 | Stroup | 160/201 X |
| 3,235,040 | 2/1966 | Ellis | 52/809 |
| 3,347,305 | 10/1967 | Urbanick | 160/40 |
| 3,511,301 | 5/1970 | Graham et al. | 160/232 X |
| 3,786,609 | 1/1974 | Difazio | 52/309.9 X |
| 4,156,448 | 5/1979 | Bengtsson | 160/232 |
| 4,183,393 | 1/1980 | Bailey | 52/309.9 X |
| 4,284,119 | 8/1981 | Martin et al. | 160/232 |
| 4,368,772 | 1/1983 | Bouthillier | 160/232 |
| 4,379,480 | 4/1983 | Kempel et al. . | |
| 4,518,026 | 5/1985 | Otto et al. . | |

*Primary Examiner*—Ramon S. Britts
*Assistant Examiner*—David M. Purol
*Attorney, Agent, or Firm*—Dorsey & Whitney

[57] ABSTRACT

The disclosure herein describes a sectional type door formed of a plurality of adjacent hingedly connected sections; each section comprises a core of insulating material and, a pair of spaced elongated metal panel members adhesively bonded to the opposite main surfaces of the core. The top and bottom edges of the panel members define respective tongue and recessed areas with the tongue area being insertable in the recessed area of an adjacent section. One or more U-shaped retaining members are mounted to the top and bottom edges of the core and serve as retaining members for the top and bottom edges of the panel members. The configuration of the top and bottom edges of the panel members is such as to provide minimum air infiltration while allowing relative movement between two adjacent sections. The metal panel members are somewhat larger than the core member thereby defining opposite end cavities in which are received wood stiles.

7 Claims, 2 Drawing Sheets

SECTIONAL-TYPE DOOR

FIELD OF THE INVENTION

The present invention relates to laminated panels fabricated of sheet metal between which is disposed a core of insulating material. The invention is particularly concerned with a sectional type door formed of a plurality of adjacent hingedly connected sections.

BACKGROUND OF THE INVENTION

Conventional sectional-type doors, such as those used as garage doors, comprise symmetrical metal panel members bonded to a foam core.

In U.S. Pat. Nos. 4,379,480 issued Apr. 12, 1983 and 4,518,026 issued May 21, 1985, both to Garland Manufacturing Co., there is described a laminated building structure for a sectional-type door which incorporates a baffle arrangement along the side edges thereof, thus enabling the structure to be utilized for such installations as sectional-type overhead garage doors. In both these patents, however, the configuration of the bottom and top edges of two adjacent sections is such that an important air gap is provided between two sections which allows for air infiltration. Such air gap also reduces the rigidity of the joining of two adjacent sections.

OBJECTS AND STATEMENT OF THE INVENTION

It is an object of the present invention to provide such sectional-type doors where the air gap between two adjacent sections is greatly reduced.

It is also an object of the present invention to provide an edge configuration where the bending operations of the material are less strict which facilitates the cold-rolling operation and limits material fatigue during production.

It is also an object of the present invention to increase the surface contact between two adjacent sections to increase the rigidity of the joint.

It is a further object of the present invention to conceal the panel retaining members which are mounted on the core.

The present invention therefore relates to a sectional-type door consisting of a plurality of adjacent hingedly connecting sections, each section comprising:

(a) a unitary expanded core fabricated of heat insulating material and having a rectangular shape with top, bottom and side edges;

(b) one or more U-shaped members fixedly mounted to the top and bottom edges of the core; the members displaying, on an intermediate wall thereof, at least one pair of outwardly projecting retaining means;

(c) first and second spaced elongated metal panel members of identical cross-sectional shape; each panel member having a main surface adhesively bonded to the core, and first and second horizontal edges; the first horizontal edges of the panel members being formed to provide a tongue area and the second horizontal edges of the panel members being formed to provide a recessed area; the tongue area being insertable in the recessed area of an adjacent section;

each of the first horizontal edges including: a first inwardly projecting portion adjacent the main surface; an inclined portion extending from the first portion; a second inwardly projection portion extending from the inclined portion; a straight portion extending perpendicularly to the second inwardly projecting portion; and a reverse bend portion extending from the parallel portion;

each of the second horizontal edges including: a first inwardly projecting portion adjacent the main surface; an inclined portion extending from the inwardly projecting portion; a second inwardly projecting portion extending from the inclined portion and a reverse bend portion extending from the second inwardly projecting portion;

the first and second inwardly projecting portions and the inclined portions of both first and second horizontal edges being substantially parallel to one another with little clearance therebetween to provide minimum air infiltration in said areas while allowing limited relative movement therebetween;

the reverse bend portions of the first horizontal edges being spaced from each other and the reverse bend portions of the second horizontal edges being spaced from each other to prevent contact between said panel members; the reverse bend portions of the first and second horizontal edges engaging the retaining means of the U-shaped members;

the main surfaces of the panel members being larger than the core so as to define a cavity at each opposite side edges of the core;

(d) a structural member received in each the cavity; and (e) a resilient weather seal extending the entire length of said section between said first horizontal edges of said panel members of one section and said second horizontal edges of the panel members of an adjacent section; said weather seal being retained between said straight portions of said first horizontal edges.

According to one embodiment of the present invention, the weather seal is shaped with a tubular portion contacting the first and second horizontal edges of two adjacent sections and a pair of leg portions compressed between the straight portions of the first horizontal edges.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the present invention will become apparent to those skilled in the art.

DESCRIPTION OF PREFERRED EMBODIMENTS

Figure 1:
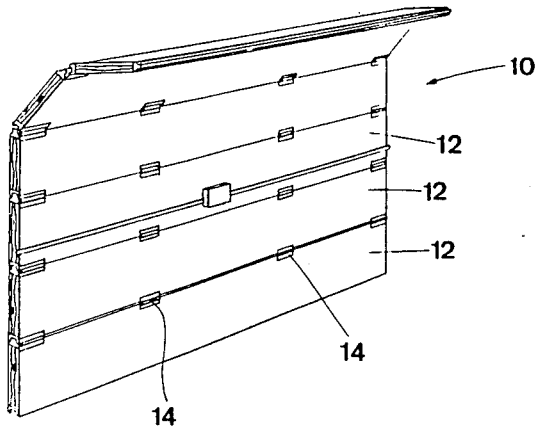
FIG. 1 is a front perspective view of a sectional type door made in accordance with the present invention.

Referring to FIG. 1, there is shown a garage door structure 10 comprising a plurality of horizontally disposed sections 12 which are hingedly connected to one another by means of hinge assemblies 14.

Figure 2:
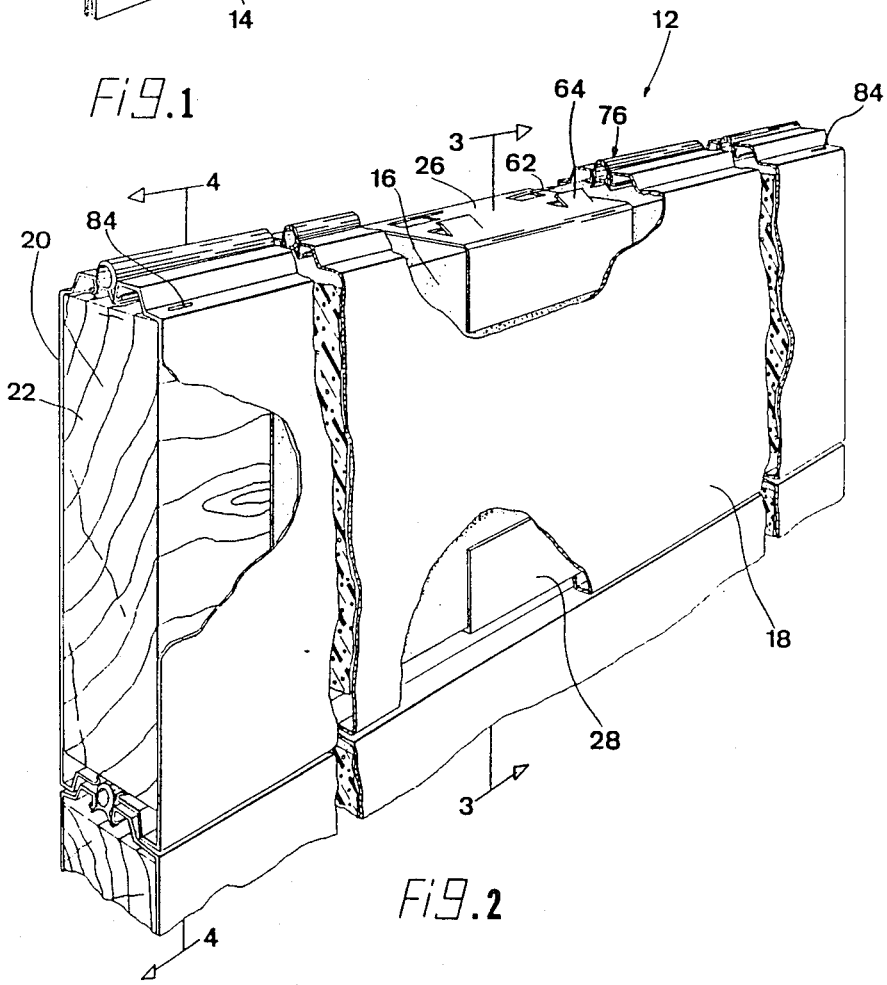
FIG. 2 is a top perspective view of one section of the door with parts broken away.

Referring to FIG. 2, one section 12 of the door is shown and comprises an inner core 16 of heat insulating material having a rectangular shape. A pair of metal side panels 18 and 20 are adhesively bonded to the opposite main surfaces of the core. These surface areas are somewhat larger than the rectangular core so as to define, at each opposite end, a pair of cavities which are filled by means of a pair of wood stiles 22 and 24. To the upper and lower edges of the core are mounted one or more U-shaped members 26 and 28 (which will be further described hereinbelow).

Figure 3:
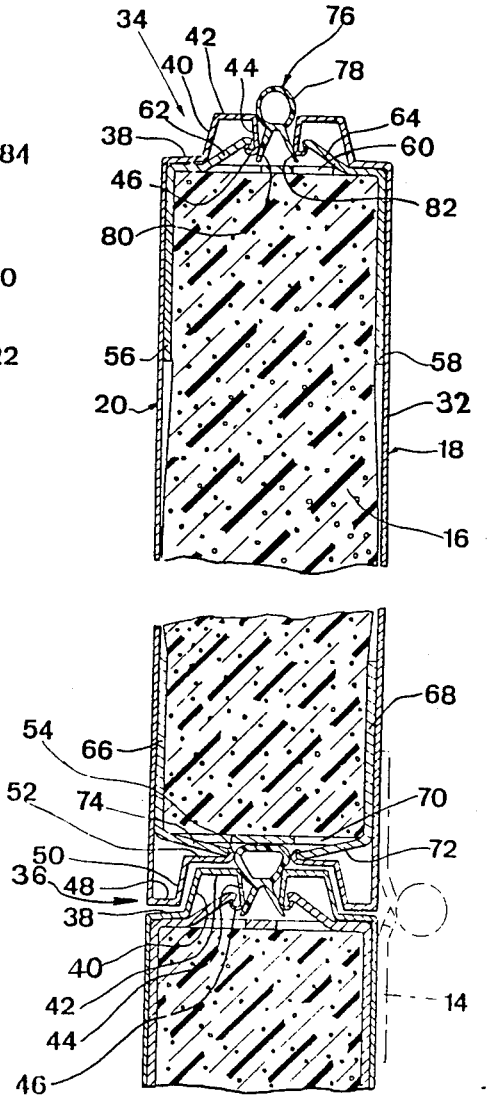
FIG. 3 is a cross-sectional view taken along lines 3—3 of FIG. 2.

Referring more particularly to FIG. 3, the panels 18 and 20 are of identical cross-sectional shape and a description will now be given with reference only to panel 18 with the understanding that a corresponding identical description may be given for panel 20.

Panel member 18 comprises a main surface 32, which is adhesively bonded to the core 16, a first or top horizontal edge generally denoted 34 and a second or bottom horizontal edge generally denoted 36. The top horizontal edge 34 defines a first inwardly projecting portion 38 adjacent the main surface 32, an inclined portion 40 extending from the first portion 38, a second inwardly projecting portion 42 extending from the inclined portion 40, a straight vertical portion 44 extending perpendicularly to the portion 42 and a reversed bend portion 46 extending from the straight portion 44.

The lower horizontal edge defines a first inwardly projecting portion 48, an inclined portion 50 extending from portion 48, a second inwardly projecting portion 52 extending from portion 50 and a reverse bend portion 54 extending from portion 52.

The lower horizontal edges 36 of both panel members 18 and 20 define a recessed area while the top horizontal edges of the side panel members 18 and 20 define a tongue area which is received in the said recessed area.

FIG. 3 shows the top horizontal edge of a similarly constructed lower adjacent section 12. Portions 38 and 48, portions 40 and 50 and portions 42 and 52 of these two adjacent sections are respectively substantially parallel to one another with minimum clearance (the spacing in the drawings have been exaggerated for clarity purposes) to maximize contact area between the respective portions thereby limiting air infiltration between the sections and also to solidify the joint formed in that hinge area.

The panel members 18 and 20 are mounted to the core member 16 by means of an inter-engagement with the retaining members 26 and 28 mounted on the top and bottom edges of the core member. The retaining member 26 defines a pair of side walls 56 and 58 and an intermediate wall 60. The latter is deformed at two locations to define two pairs of upwardly extending portions 62 and 64, the projections of a pair facing one another. Similarly, the bottom retaining member 28 comprises a pair of side walls 66 and 68 and an intermediate wall 70 which is deformed to define a pair of facing projections 72 and 74. The ends of the projections 62 and 64 are slightly curved while that of projections 72 and 74 are straight. The slightly curved extremities of projections 62 and 64 are engaged with the reversed bend portions 46 of the side panels 18 and 20. The lower retaining member 28 has its projections 72 and 74 engaged under the reversed bend portions 54 of the side panels 18 and 20.

A resilient weather seal 76 is provided in the tongue and recessed areas between two sections of the door for the entire length thereof. The seal comprises a tubular portion 78 and a pair of leg portions 80 and 82. The tubular portion 78 extends between the inwardly projecting portions 42 and 52 of the side panels 18 and 20 of two sections while the pair of leg portions 80 and 82 is resiliently compressed between the straight portions 44 of the side panels 18 and 20.

Figure 4:
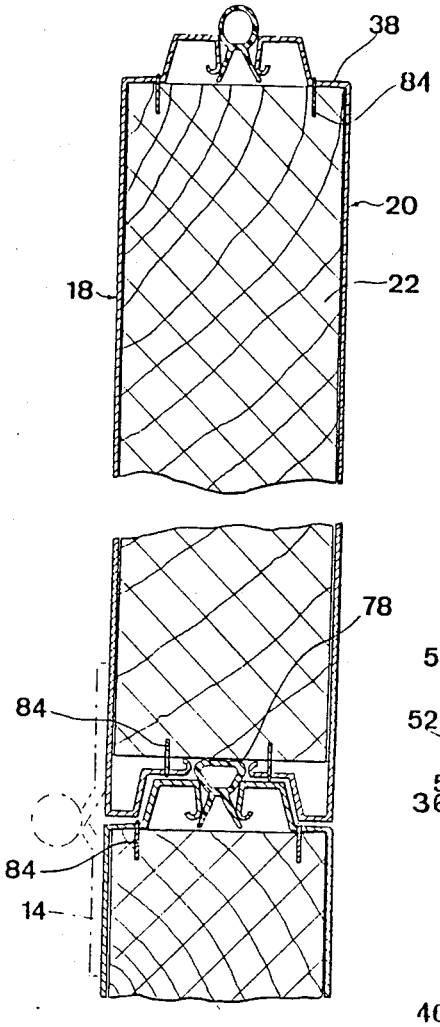
FIG. 4 is a cross-sectional view taken along lines 4—4 of FIG. 2.

Referring to FIG. 4, the side panels 18 and 20 are adhesively bonded at their opposite sides to wood stiles 22 and 24. However, for further securing the panels to these wood stiles, staples 84 or other fastening means may be used to affix portions 38 and 52 of the panels to the wood stiles 24.

The assembly of a section will now be described. The retaining members 26 and 28 are clipped on, at appropriate location, depending of the width of a door, to the top and bottom edges of core 16. Then, the inner face of one panel member 18, for example, is fully covered with an adhesive and adhered to one main surface of the core. The wood stiles 22 and 24 are then mounted at each end of the core in the areas defined by the panels being larger than the core and are adhesively bonded to the main surface of the side panel 18. The bend portion 54 is located so as to engage the projection 74. Then, the main surface 32 of the panel is pressed against the core with portion 46 sliding along the intermediate wall 60, up along projections 62 and then pressed so that it slides underneath the rounded extremities of the projections.

A second panel 20 is covered with adhesive on its inner face and mounted in a similar fashion to the core by having its lower bend portion 54 engaged with the projection 72 with the upper portion being pressed fitted so that the bend portion 46 engages underneath the projection 64.

Then, a stapling procedure at the opposite ends of the section is carried out to further secure the top and bottom edges of the panels to the wood stiles 22 and 24. Finally, the leg portions 80 and 82 of the resilient weather seal 76 are compressed to fit between the two straight portions 44 of the panels 18 and 20 and then longitudinally slid the entire length of the section.

The remaining procedure of mounting these sections together to form a door is conventional such as described for example, in the above referred United States patent.

Although one specific form of the invention has been described, it will be evident to the person skilled in the art that it may be refined and modified in various ways. It is therefore wished to have it understood that the present invention should not be limited in interpretation, except by the terms of the following claims.

The embodiments of the invention in which an exclusive property or privilege is claimed are defined as follows:

1. A sectional-type door consisting of a plurality of adjacent hingedly connected sections, each section comprising:

(a) a unitary expanded core fabricated of heat insulating material and having a rectangular shape with top, bottom and side edges;

(b) at least one U-shaped member fixedly mounted to said top and bottom edges of said core; said members displaying, on an intermediate wall thereof, at least one pair of outwardly projecting retaining means;

(c) first and second spaced elongated metal panel members of identical cross-sectional shape; each panel member having a main surface adhesively bonded to said core, and first and second horizontal edges; said first horizontal edges of said panel members being formed to provide a tongue area and said second horizontal edges of said panel members being formed to provide a recessed area; said tongue area being insertable in said recessed area of an adjacent section;

each of said first horizontal edges including: a first inwardly projecting portion adjacent said main surface; an inclined portion extending from said first portion; a second inwardly projection portion extending from said inclined portion; a straight portion extending perpendicularly to said second inwardly projecting portion and rearwardly towards said core; and a reverse bend portion at the end of said straight portion;

each of said second horizontal edges including: a first inwardly projecting portion adjacent said main surface; an inclined portion extending from said inwardly projecting portion; a second inwardly projecting portion extending from said inclined portion and a reverse bend portion at the end of said second inwardly projecting portion, said reverse bend portion being bent rearwardly towards said core;

said first and second inwardly projecting portions and said inclined portions of both first and second horizontal edges being substantially parallel to one another with little clearance therebetween to provide minimum air infiltration in said areas while allowing limited relative movement therebetween;

said reverse bend portions of said first horizontal edges being spaced from each other and said reverse bend portions of said second horizontal edges being spaced from each other to prevent contact between said panel members; said reverse bend portions of said first and second horizontal edges engaging said retaining means of said U-shaped members;

said main surfaces of said panel members being larger than said core so as to define a cavity at each opposite side edges of said core;

(d) a structural member received in each said cavity; and (e) a resilient weather seal extending the entire length of said section between said first horizontal edges of said panel members of one section and said second horizontal edges of said panel members of an adjacent section; said weather seal extending and being retained between said straight portions of said first horizontal edges and said reverse bend portions of said second horizontal edges.

2. A door as defined in claim 1, wherein said weather seal includes tubular portion contacting said reverse bend portions of said second horizontal edges and a pair of resilient leg portions compressed between said straight portions of said first horizontal edges.

3. A door as defined in claim 1, wherein said structural members are adhesively bonded to said metal panel members.

4. A door as defined in claim 3, wherein said structural members are of wood stiles of rectangular section.

5. A door as defined in claim 4, wherein said first inwardly projection portions are stapled to said stiles.

6. A door as defined in claim 1, wherein each said intermediate wall of said U-shaped members includes two pairs of opposite and distantly disposed retaining means.

7. A door as defined in claim 6, wherein said retaining means consist of deformed portions of said intermediate wall.

* * * * *